US011547214B2

(12) United States Patent
Smit

(10) Patent No.: US 11,547,214 B2
(45) Date of Patent: Jan. 10, 2023

(54) SEAT, PARTICULARLY FOR VIDEO GAMES, AND HINGE FOR USE THEREIN

(71) Applicant: F. SMIT HOLDING B.V., Doetinchem (NL)

(72) Inventor: Fernando Smit, Doetinchem (NL)

(73) Assignee: F. SMIT HOLDING B.V., Doetinchem (NL)

( * ) Notice: Subject to any disclaimer, the term of this patent is extended or adjusted under 35 U.S.C. 154(b) by 0 days.

(21) Appl. No.: 17/418,341

(22) PCT Filed: Dec. 27, 2019

(86) PCT No.: PCT/NL2019/050878

§ 371 (c)(1),
(2) Date: Jun. 25, 2021

(87) PCT Pub. No.: WO2020/139087

PCT Pub. Date: Jul. 2, 2020

(65) Prior Publication Data

US 2022/0087435 A1 Mar. 24, 2022

(30) Foreign Application Priority Data

Dec. 28, 2018 (NL) ..... 2022326

(51) Int. Cl.
*A47C 15/00* (2006.01)
*A47C 4/50* (2006.01)

(52) U.S. Cl.
CPC ..... *A47C 15/004* (2013.01); *A47C 4/50* (2013.01)

(58) Field of Classification Search
CPC .... A47C 4/48; A47C 4/24; A47C 4/14; A47C 4/50

(Continued)

(56) References Cited

U.S. PATENT DOCUMENTS 3,138,400 A * 6/1964 Reid ..... A47C 4/50 297/363
3,365,209 A * 1/1968 Fischer ..... B62B 13/16 403/96

(Continued)

FOREIGN PATENT DOCUMENTS

CN 204105363 U * 1/2015
EP 702162 A2 * 3/1996 ..... F16C 11/10

(Continued)

OTHER PUBLICATIONS

International Search Report and Written Opinion for the International Patent Application No. PCT/NL2019/050878, dated Feb. 4, 2020, 12 pages.

*Primary Examiner* — Milton Nelson, Jr.
(74) *Attorney, Agent, or Firm* — KDB Firm PLLC

(57) ABSTRACT

A seat, particularly for video games, includes a collapsible frame which carries a seat surface and a backrest. The frame includes a first part carrying the backrest and a second part configured to carry a console for a steering wheel or joystick for controlling a video game. These parts are connected pivotally to each other by a hinge. The hinge includes a first load-bearing body on which the first frame part is mounted, and a second load-bearing body on which the second frame part is mounted. The hinge has locking means for fixating the first and second frame parts in a desired position relative to each other. A hinge for application in such a seat.

12 Claims, 8 Drawing Sheets

(58) Field of Classification Search
USPC ..... 297/56, 57, 452.2, 440.24
See application file for complete search history.

(56) References Cited

U.S. PATENT DOCUMENTS

| | | | | |
|---|---|---|---|---|
| D846,975 | S * | 4/2019 | Arcot | D8/382 |
| 10,653,242 | B2 * | 5/2020 | Ortiz | A47C 7/72 |
| 2016/0338492 | A1 * | 11/2016 | Piretti | A47C 4/24 |
| 2018/0332953 | A1 | 11/2018 | Solomon et al. | |

FOREIGN PATENT DOCUMENTS

| | | | | |
|---|---|---|---|---|
| EP | 2374375 | A1 | 10/2011 | |
| EP | 2702902 | A1 | 3/2014 | |
| FR | 1362318 | A | 5/1964 | |
| WO | WO-2012069670 | A1 * | 5/2012 | A47C 15/004 |

* cited by examiner

SEAT, PARTICULARLY FOR VIDEO GAMES, AND HINGE FOR USE THEREIN

"This is a national stage application filed under 35 U.S.C. § 371 of international application PCT/NL2019/050878, filed Dec. 27, 2019, which claims priority to Netherlands Patent Application No. NL 2022326, filed Dec. 28, 2018, the entirety of which applications are hereby incorporated by reference herein."

The invention relates to a seat, particularly for video games, comprising a collapsible frame which carries a seat surface and a backrest, wherein the frame comprises a first part carrying the backrest and a second part configured to carry a console for a steering wheel or joystick for controlling a video game, which parts are connected pivotally to each other by means of a hinge. Such a seat is known, for instance from EP 2 702 902 A1.

The known seat 1 has a scissor construction and has frame 2 with a relatively long tubular frame part 3 which is covered with the backrest 4, and a shorter frame part 5 which carries at its upper end 6 a sub-frame 16 with a console 7 for a steering wheel and/or joystick (not shown here) (FIG. 1, 2). The two frame parts 3, 5 are connected pivotally to each other by means of a hinge 8 and in folded-out position form an X-shape in side view. Above hinge 8 a seat surface 9 is here tensioned between the two frame parts 3, 5. This seat surface 9 forms a whole with backrest 4. The degree of unfolding of known seat 1 is bounded by two straps 10 which are tensioned between the two frame parts 3, 5 and form two armrests in the folded-out position. A support 11 for a pedal set (not shown here) can be mounted on the underside of the longer frame part 3 which carries backrest 4. This pedal support 11 can be connected pivotally to frame part 3 by means of a spacer 12.

The known seat 1 has the drawback that its folded-out position is determined by the dimensions of straps 10 and the position of their mounting points 14, 15 on the two frame parts 3, 5. In order to vary this position the length of the straps must thus be adjusted, wherein it is difficult to keep them exactly the same. The invention has for its object to improve a seat of the above described type such that said drawbacks do not occur, or at least do so to lesser extent.

According to a first aspect of the invention, this is achieved in a seat as described in the preamble in that the hinge comprises a first load-bearing body on which the first frame part can be mounted, and a second load-bearing body on which the second frame part can be mounted, and in that each load-bearing hinge body has at least two points, lying substantially opposite each other, for mounting of the first or second frame part. Embodying the hinge as load-bearing or structural component, for instance as a light-metal casting comprising a first and second load-bearing hinge body, enables the rest of the construction of the seat to take a lighter and simpler form. And in contrast to the known scissor-like seat, wherein each frame part extends on either side of the hinge, the hinge of the invention allows such a frame part as it were to be subdivided into two segments which are arranged on either side of the hinge and are mutually connected by means of the load-bearing hinge. This results in smaller components and therefore a smaller packaging, which can be offered for sale in a shop more easily.

The frame can here for instance comprise at least four parts mounted on the hinge. In this way the frame parts of the conventional scissoring folding seat can thus each be divided into two, which makes them easier to package.

According to an embodiment of the seat, the first and second frame part each comprise a number of mutually connected tubular elements. By constructing the frame parts not integrally but from different elements they can be taken apart into smaller components, whereby they can be packaged more easily.

In an embodiment of the seat at least some of the frame parts each comprise three tubes which are assembled by means of two corner pieces into a substantially U-shaped frame part.

According to a second aspect of the invention, in a seat as described above the hinge can have locking means for fixating the first and second frame parts in a desired position relative to each other. As a result of the presence of these locking means the frame parts can be fixated without straps functioning as armrests being necessary for this purpose. The absence of such straps considerably simplifies getting into and out of the seat.

The locking means can here be configured to fixate the first and second frame parts in different positions. A user can thus choose and set a desired position of the backrest relative to the seat surface, without being limited herein to a position which is determined by the length of the straps functioning as armrests.

The locking means can be form-fitting, whereby a stable fixation of the frame parts is ensured.

In an embodiment of the seat the hinge can comprise two hinge parts rotatable relative to each other and the locking means can comprise two locking parts, each connected to one of the hinge parts, wherein one of the locking parts can comprise a number of recesses and the other locking part can comprise at least one protrusion engaging in a recess. By having the protrusion engage as desired in one of the recesses a desired relative position of the frame parts can be set.

One of the locking parts can here be integrated with the first load-bearing hinge body, while the other locking part can be integrated with the second load-bearing hinge body. A compact, strong and rigid construction is thus obtained.

In order to enable a large number of different positions the locking parts which are displaceable relative to each other can each be provided with a toothing. Displacing the locking parts in each case over a tooth pitch enables relatively small steps to be made so that an accurate adjustment of the relative position is possible.

A compact construction is obtained when the toothings each run at least partially circularly and the locking parts are rotatable relative to each other.

In an embodiment of the seat the locking parts can be movable between a first position in which they engage in each other and a second position in which they are displaceable relative to each other, wherein the locking means can further comprise at least one securing member for securing the displaceable locking parts in the first position. After they have been displaced to a desired position the locking parts can thus be secured or fixated relative to each other, whereby the mutual distance of the frame parts is also fixed.

The at least one securing member can here comprise an eccentric. With such an eccentric, which can for instance be formed at the end of a lever, the locking parts can be secured in a determined position relative to each other in rapid and simple manner.

It is otherwise also possible to envisage the frame parts being connected by a hinge with ratchet function. Such a hinge, which is structurally simple, allows a stepwise movement in one direction until an end position has been passed, after which the hinge can be moved back to a starting position in the opposite direction.

In order to be able to fold up the seat very compactly and package it in a small package it is preferred for the seat surface and/or the backrest to be manufactured from a flexible material. The material of the seat surface and/or the backrest can for instance be cloth. The seat and the backrest can otherwise be formed integrally.

The invention also relates to a load-bearing hinge which is evidently intended for application in a seat as described above.

The invention will now be elucidated on the basis of an embodiment compared to a conventional seat. Reference is made here to the accompanying drawing in which corresponding components are designated with reference numerals increased by 100, and in which.

Figure 4:
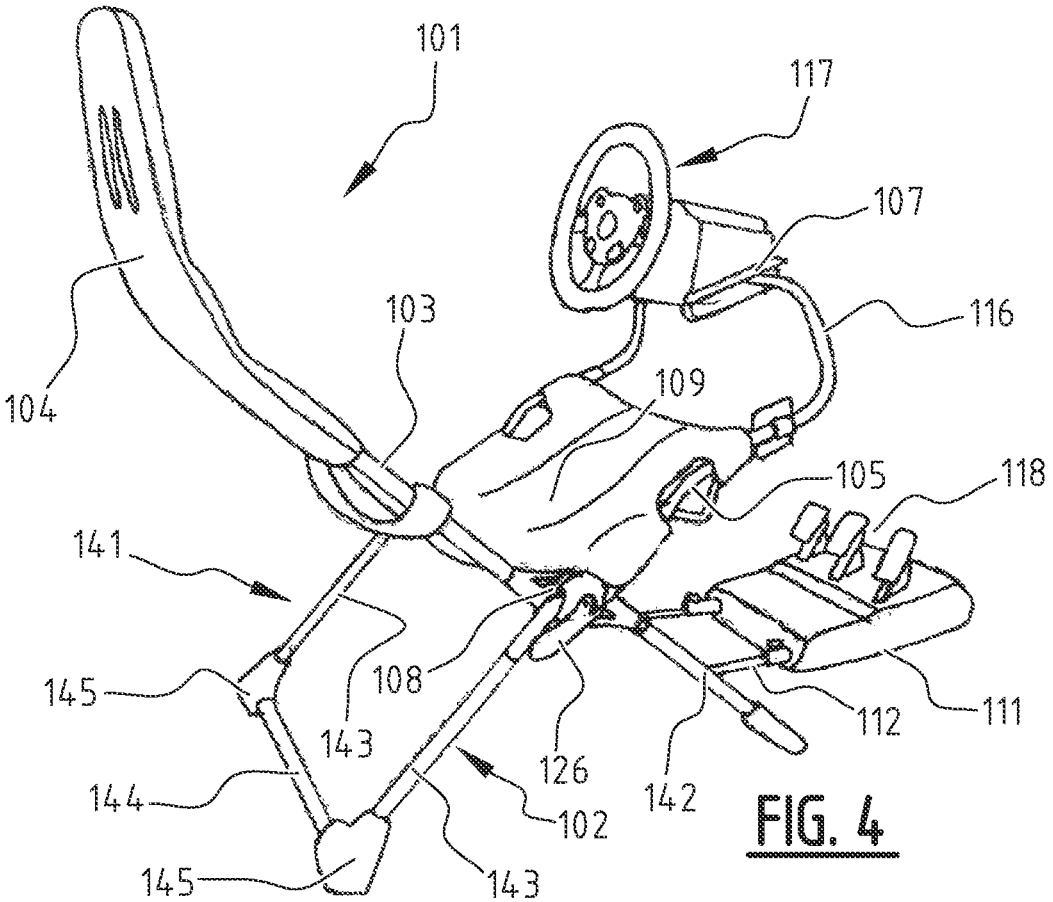
Figure 5:
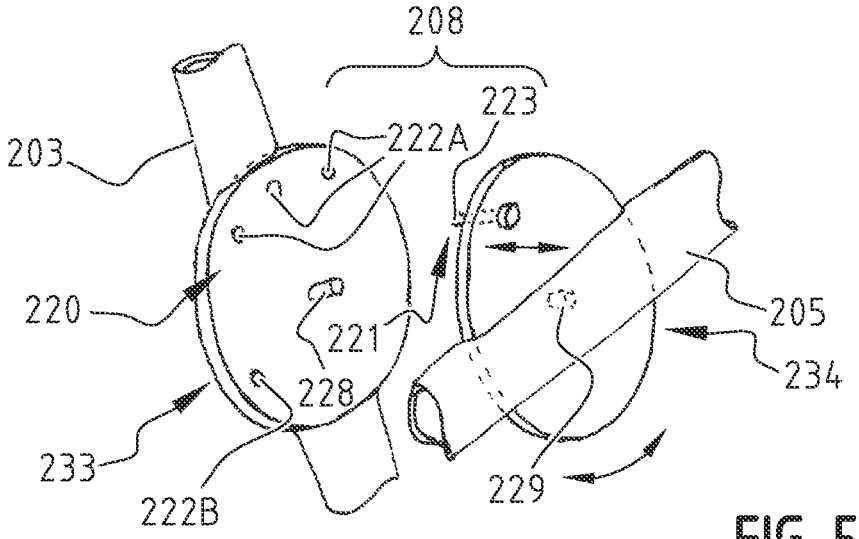
Figure 6:
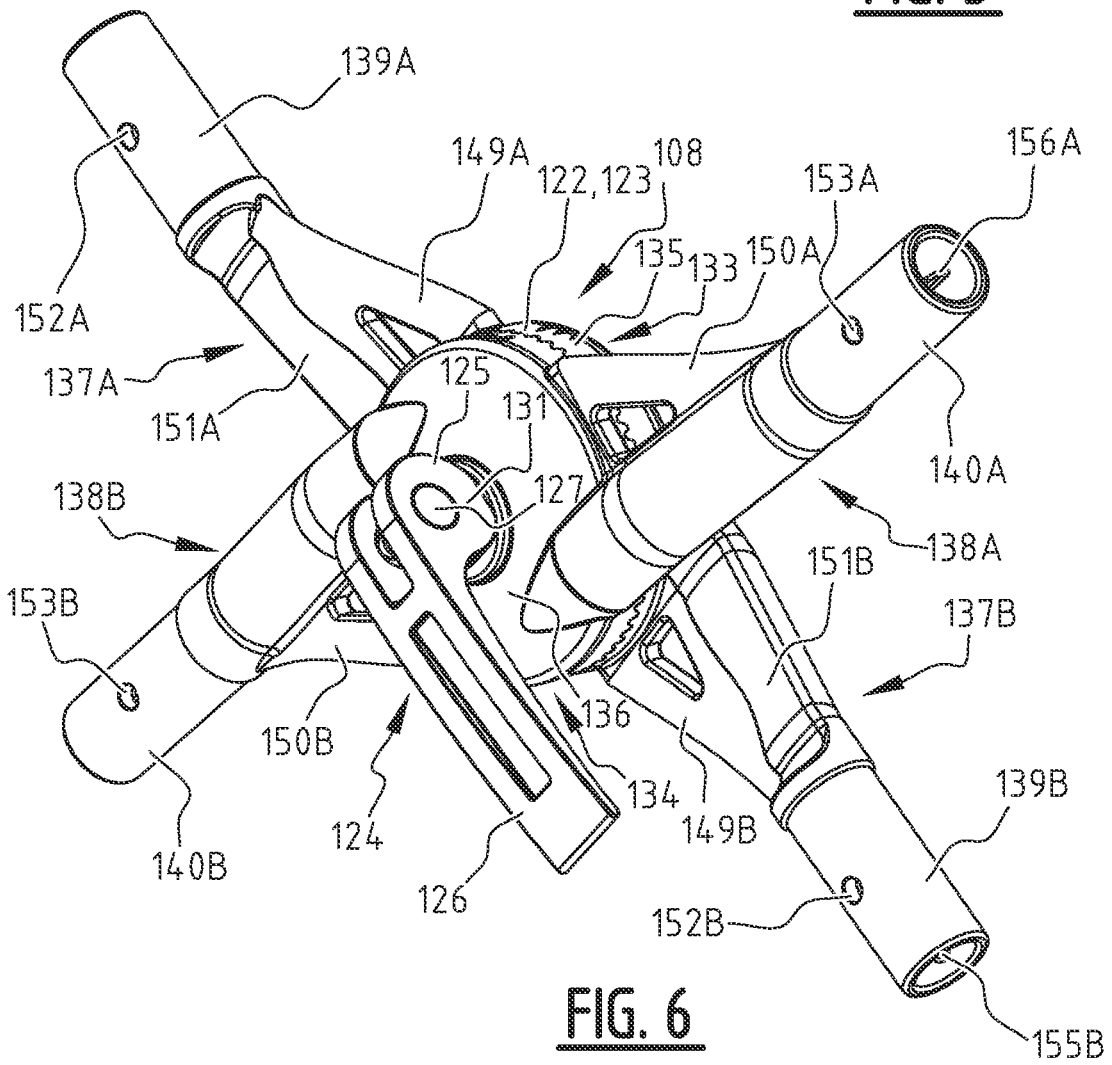
Figure 7:
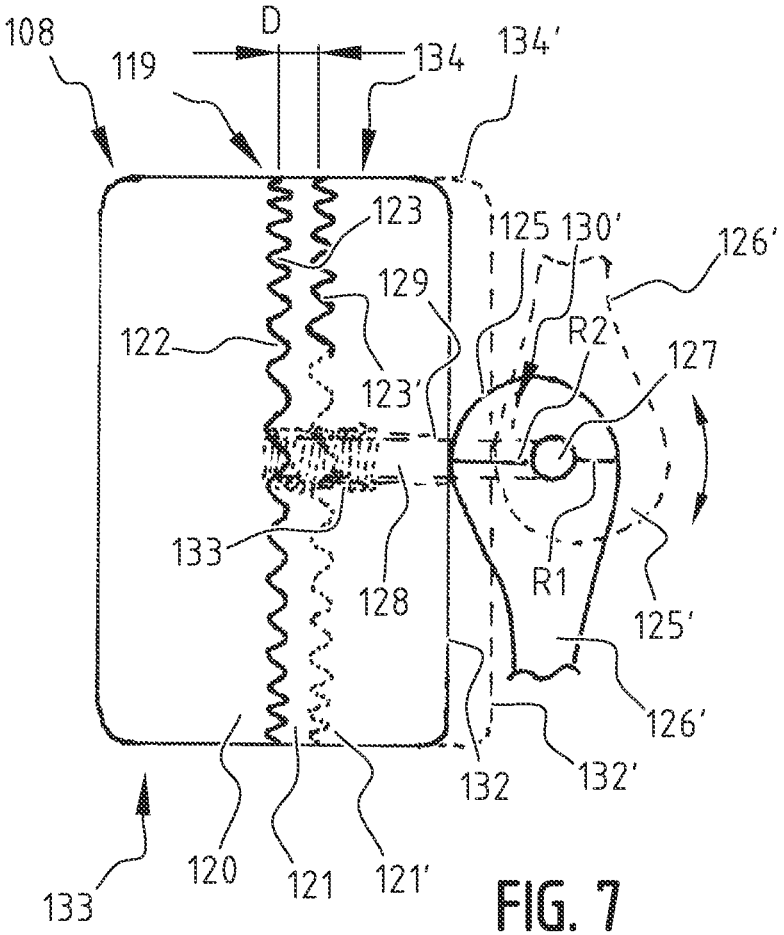
Figure 8:
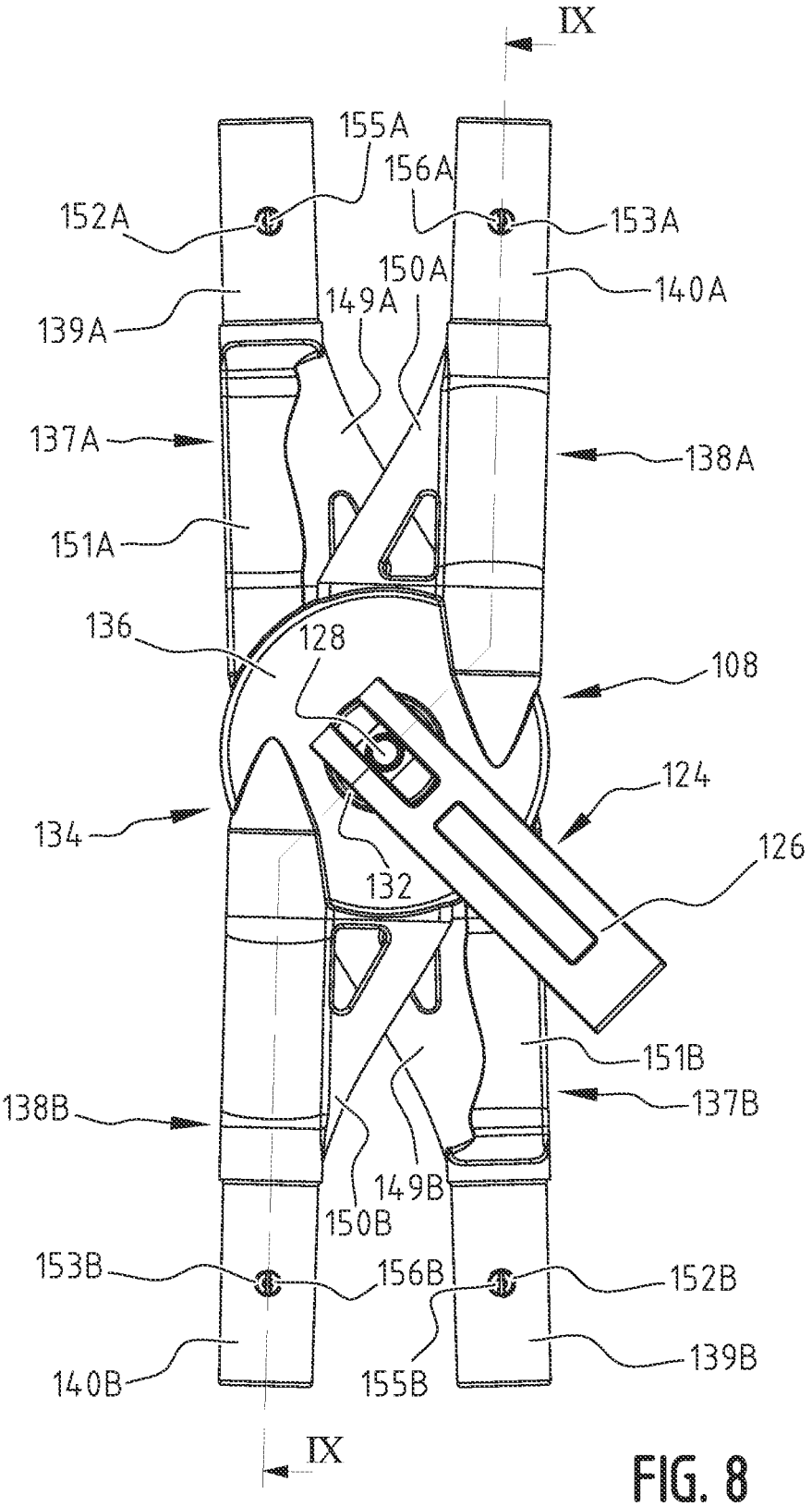
Figure 9:
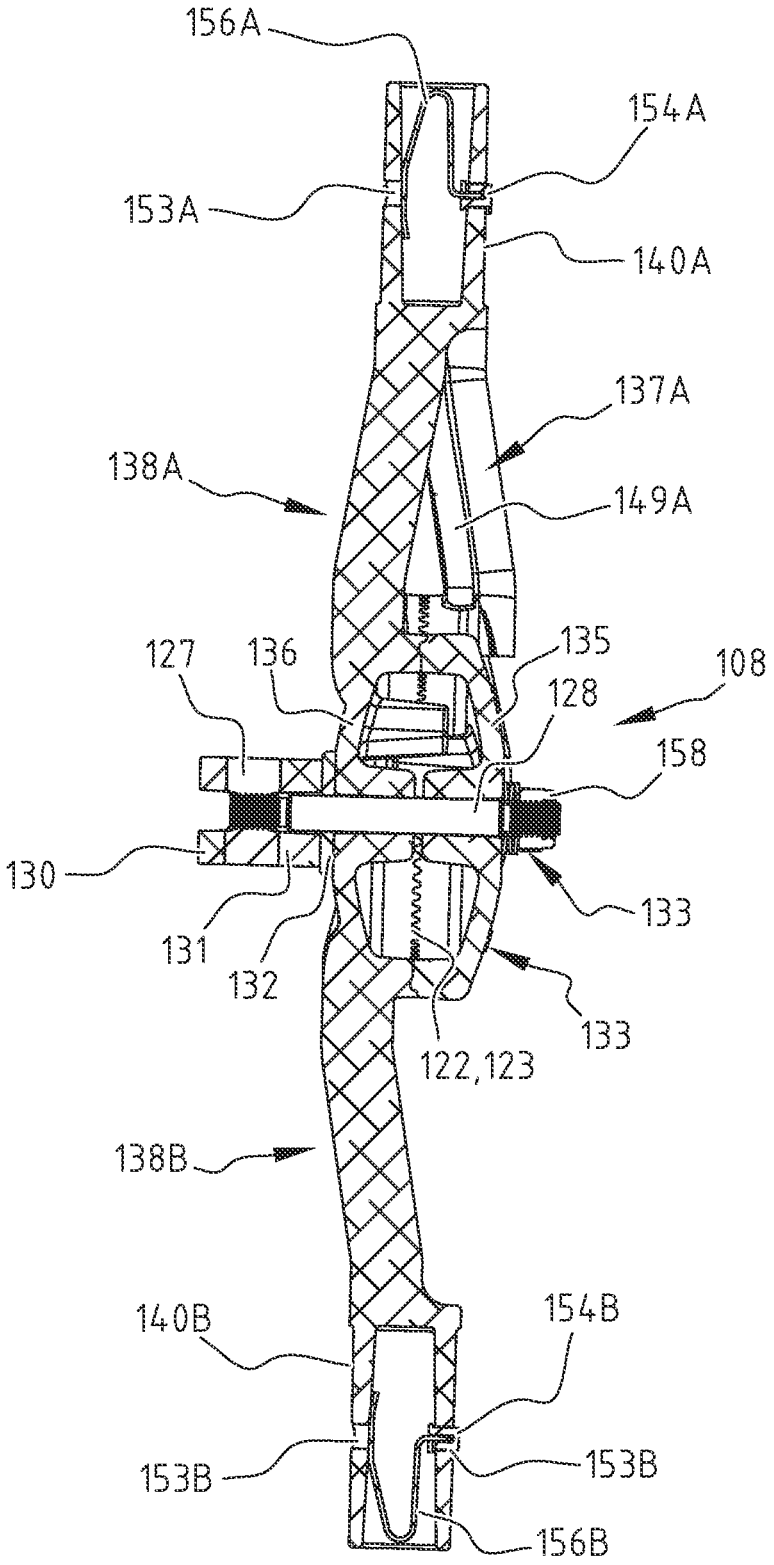
Figure 10:
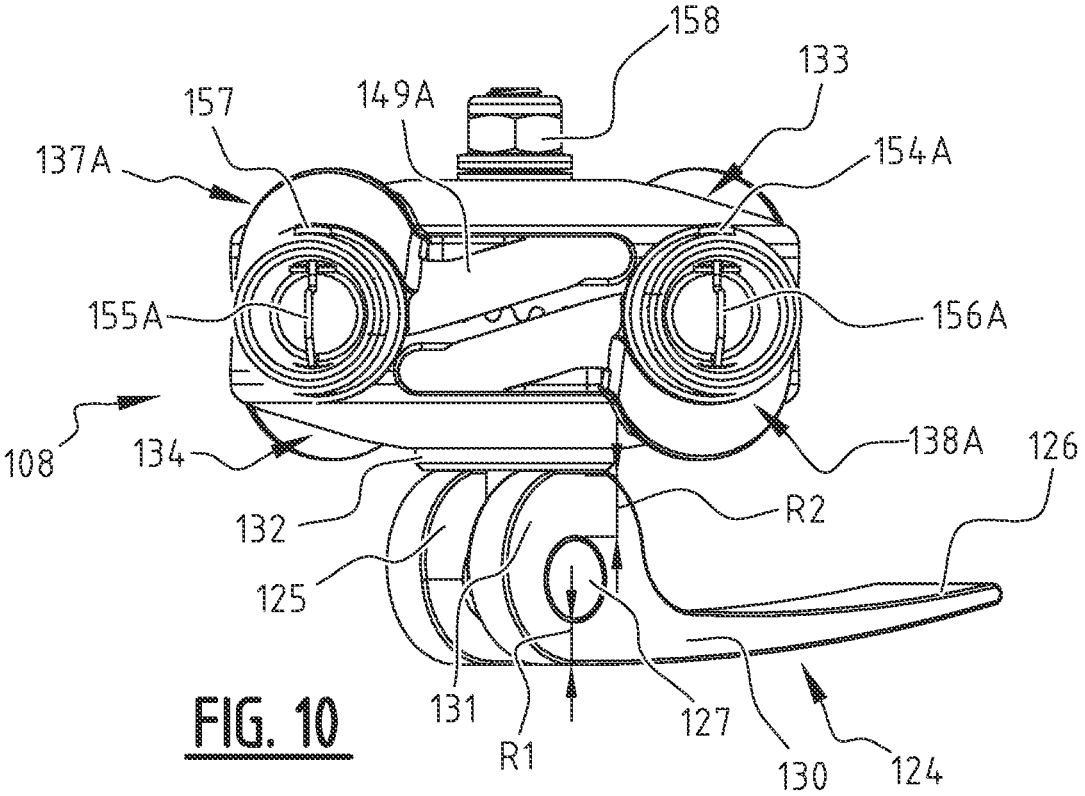
Figure 11:
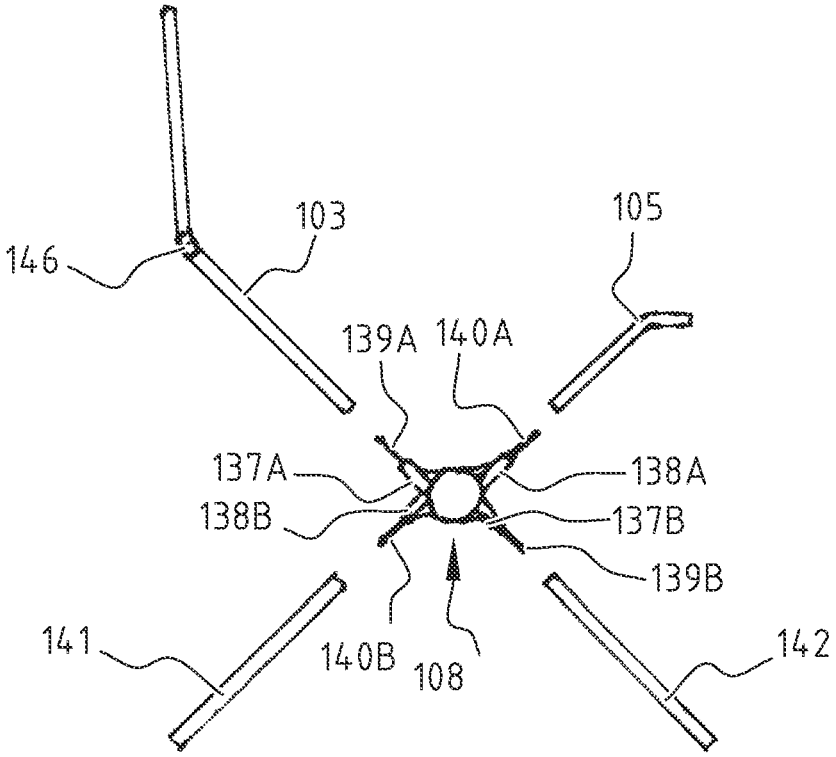
Figure 12:
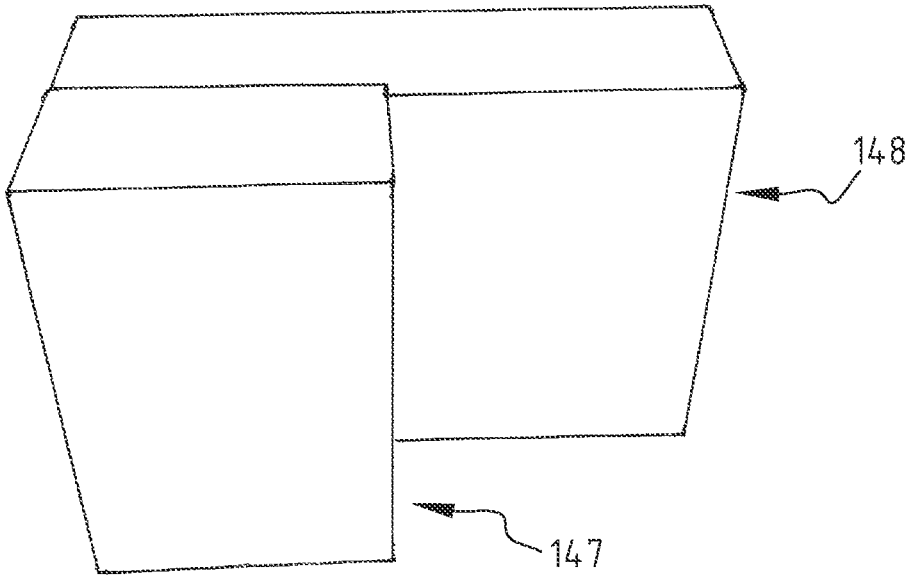

FIG. 4 is a perspective side view of a seat according to the invention in folded-out position, FIG. 5 shows schematically an embodiment of a lockable hinge with exploded parts, FIG. 6 is a perspective detail view on enlarged scale of the hinge of the seat of FIG. 4, FIG. 7 is a schematic view of a hinge in which the locked and unlocked position are shown, FIG. 8 is a front view of the hinge of FIG. 6 in collapsed position, FIG. 9 is a cross-section through the hinge along the line IX-IX in FIG. 8, FIG. 10 is a top view of the hinge of FIG. 8, FIG. 11 is a side view with exploded parts of the seat of FIG. 4, and FIG. 12 is a perspective view of a packaging for the seat according to the invention compared to a packaging for a conventional seat.

Figure 2:
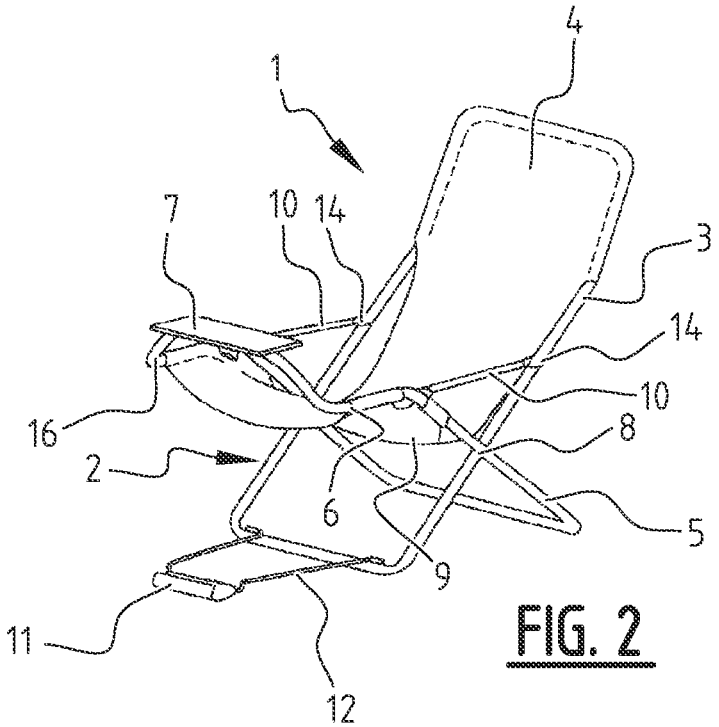
FIG. 2 is a view corresponding with FIG. 1 of the known seat in folded-out and fully mounted state.

In the prior art seat 1 already briefly described above the relatively long tubular part 3 of frame 2, which is covered with backrest 4, and the shorter frame part 5 which carries the console 7 for a steering wheel or the joystick are connected pivotally to each other by means of hinge 8. Known seat 1 is thereby movable between a collapsed position in which seat 1 can be stored (FIG. 3) and a folded-out position of use (FIG. 2). In this seat 1 the console 7 and pedal support 11 also take a pivotable form, respectively by interposing of simple brackets 13 with which console 7 is mounted on sub-frame 16 and by interposing of spacer 12. In the known seat 1 the folded-out position of use is bounded by two straps 10 which are tensioned between frame parts 3, 5 and in the folded-out position form two armrests. The folded-out position of use is determined by adjusting the length of these straps 10.

A seat 101 according to the invention, which is intended for playing video games, comprises a collapsible frame 102 which carries a seat surface 109 and a backrest 104 (FIG. 4). Seat surface 109 and backrest 104 are in this embodiment formed integrally from a flexible material, for instance a fabric. In the shown embodiment frame 102 comprises a number of separate frame parts which are connected to each other with interposing of a hinge 108. A first frame part 103 carries backrest 104, while a second frame part 105 carries a separate sub-frame 116 with thereon a console 107 on which a racing steering wheel 117 is mounted in the shown embodiment. Instead of a steering wheel 117, a joystick could also be mounted on console 107 of sub-frame 116. In order to simplify getting in and out of the seat, sub-frame 116 can be connected to frame part 105 releasably on one side and pivotally on the other side, so that it can be released and folded away to the side.

A forward-directed foot end of frame 102 carries a pivotable spacer 112 with a support 111 for a separate pedal set 118. Steering wheel 117 (or optionally the joystick) and pedal set 118 are connected to a game computer (not shown here). Seat 101 can be placed in front of a screen (not shown here either), after which a user can sit in seat 101 and can control the game using hands and feet via steering wheel 117 (or the joystick) and pedal set 118.

Figure 1:
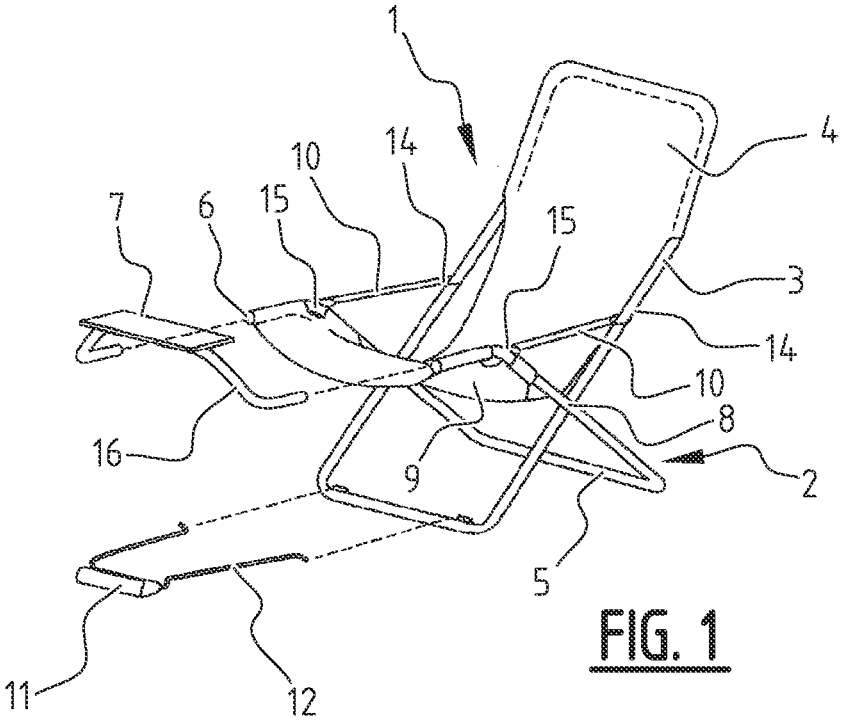
FIG. 1 is a perspective front view of a prior art seat in folded-out position, but before a console for a steering wheel or joystick and a support for a pedal set have been mounted thereon.
Figure 3:
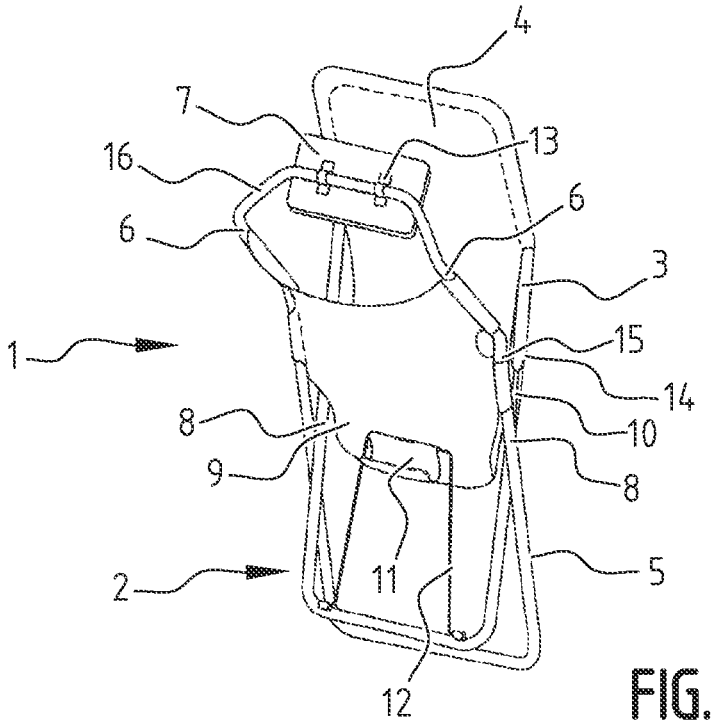
FIG. 3 is a perspective front view of the prior art seat in collapsed position.

According to an aspect of the present invention, the seat 101 shown in FIG. 4 is distinguished from the known seat 1 of FIGS. 1-3 in that hinge 108 itself can be locked, whereby the frame parts can be fixated relative to each other without having to make use of tensioning straps. This considerably simplifies getting in and out.

Hinge 108 is for this purpose provided with locking means 119. In the shown embodiment the locking means enable the frame parts to be fixated in different positions relative to each other, whereby seat 101 can be adjusted to players with various postures. The locking means can be force-locked, i.e. for instance operate according to the principle of friction, but this requires a (relatively great) force to act on the hinge under all conditions, which requires a heavy construction or requires a continuous supply of energy. In the shown example locking means 119 are therefore form-fitting; they operate according to the principle of mutually engaging parts.

In the shown embodiment hinge 108 comprises two hinge parts 133, 134 which are rotatable relative to each other. Locking means 119 comprise here two locking parts 120, 121, particularly rotatable, which are displaceable relative to each other and are each connected to one of the hinge parts 133, 134. Each locking part 120, 121 is provided with a circularly running toothing 122, 123. Locking parts 120, 121 are movable between a first position shown with full lines in FIG. 7, in which toothings 122, 123 mutually engage and the locking parts 120, 121 are thus blocked, and a second position shown with broken lines (wherein the reference numerals are provided with an accent), in which the toothings 122, 123' are held at a mutual distance. In the second position the locking parts 120, 121' and the hinge parts 133, 134' connected thereto are rotatable relative to each other, whereby the relative position of the frame parts can be varied and reset.

Locking means 119 here comprise a securing member 124 with which locking parts 120, 121 can be secured in their first position, so the locked position in which toothings 122, 123 engage in each other. In the shown embodiment this securing member 124 comprises an eccentric 125. Eccentric 125 forms part of a handle 126 which is pivotable about a shaft 127. This shaft 127 is arranged on a stem 128 which protrudes outward from first locking part 120 through a central opening 129 in second locking part 121. Eccentric 125 has a segment 130 with a relatively small radius R1 and a segment 131 with relatively large radius R2.

When handle 126 is pivoted to a first position, in which it extends substantially parallel to second locking part 121, segment 131 with relatively large radius R2 is in contact with an outer surface 132 of second locking part 121, whereby shaft 127 is situated further from this outer surface 132 and stem 128 is thus pulled into second locking part 121 on the opposite side. Toothings 122, 123 are hereby urged into engagement with each other so that the two locking parts 120, 121 are blocked relative to each other.

When frame 102 has to be placed in a different position, hinge parts 133, 134, and so with this also locking parts 120, 121, have to be rotated to a different relative position. Handle 126 is for this purpose pivoted through about 180° to a second position, in which it extends substantially parallel to second locking part 121 substantially on the other side of shaft 127. In this position of handle 126' the segment 130' with relatively small radius R1 is in contact with an outer surface 132' of second locking part 121'. Shaft 127 is thereby situated closer to this outer surface 132' and stem 128 can thus extend on the opposite side outside second locking part 121'. A distance D is hereby created between the two locking parts 120, 121', whereby the toothings 122, 123' disengage and locking parts 120, 121' can be displaced, for instance rotated, relative to each other. In order to urge the locking parts 120, 121' apart in this situation so that the displacement can be carried out unimpeded a spring 133 (only shown schematically) can be arranged therebetween.

Locking parts 120, 121 or hinge parts 133, 134 can otherwise also be provided with co-acting stop means (not shown here) for bounding the relative rotation.

In this way hinge parts 133, 134 and the frame parts connected thereto can thus quickly and easily be placed in a desired relative position and be fixated in this position in reliable manner. The number of possible positions is here bounded only by the number of teeth of the toothings 122, 123. In the shown embodiment toothings 122, 123 each have 60 teeth, whereby an angle between the frame parts can be adjusted in steps of 6°. Hinge parts 133, 134 can otherwise also be provided with markings (not shown here) with which a number of preferred settings is indicated. The two hinges 108 on either side of frame 102 can thus be placed in the same position in simple manner.

When a less accurate adjustment is necessary, it is possible to suffice with a simpler locking mechanism. FIG. 5 shows schematically a hinge 208 which connects two frame parts 203, 205 to each other. Hinge 208 comprises two hinge parts 233, 234 which are connected rotatably to each other by means of a central pin 228 and opening 229. In this embodiment a locking part 220, which is connected to hinge part 233, has only three recesses 222A for setting the angle of the backrest, and an additional recess 222B for fixating the frame in the collapsed position. The other locking part 221, which is connected to hinge part 234, is here provided with a single protrusion, for instance a spring-loaded pin 223. By pulling pin 223 from one of the recesses 222 counter to the force of the spring (not shown) hinge 208 is unlocked and locking parts 220, 221 can be rotated relative to each other until pin 223 is aligned with another recess 222. Pin 223 can then be inserted into this recess 222 in order to block locking parts 220, 221 relative to each other again. In this embodiment the frame parts 203, 205 are otherwise mounted on the outer side of the corresponding hinge parts 233, 234 and run over an axis defined by pin 228 and hole 229.

Other locking mechanisms can also be envisaged, such as for instance in the form of a hinge with a ratchet function.

According to a main aspect of the invention, seat 101 is distinguished from the known seat 1 of FIGS. 1-3 in that hinge 108 is embodied as structural component and consists of two load-bearing hinge parts or bodies 133, 134. Each load-bearing hinge body 133, 134 here comprises a central part 135, 136 which carries the toothing 122, 123 of the corresponding locking part 120, 121. In the shown embodiment this central part 135, 136 takes a cylindrical form. Each hinge body 133, 134 further comprises two spacers, respectively 137A, 137B and 138A, 138B, which extend in substantially opposite direction from central part 135, 136. Central parts 135, 136 and spacers 137A, 137B, 138A, 138B can be manufactured from the same material or from different materials. Materials which can be envisaged are steel, light metal and plastics, optionally fibre-reinforced. In the embodiment shown here each central part 135, 136 is cast integrally with the corresponding spacers 137A, 137B, 138A, 138B from aluminium.

In the shown embodiment spacers 137A, 137B and 138A, 138B are in each case mounted on central part 135, 136 staggered relative to each other, so that the frame parts come to lie adjacently of each other in the collapsed position (FIG. 8). In order to still ensure an optimal transfer of forces between spacers 137A, 137B, 138A, 138B and central part 135, 136 the spacers are in the shown embodiment provided with a substantially Y-shaped outer end, whereby a shore 149A, 149B, 150A, 150B is in each case formed. Each shore 149, 150 runs from a position roughly on the central axis of the relevant spacer 137, 138 to a position in the centre of the central part 135, 136, whereby shores 149, 150 run slightly obliquely in top view (FIG. 10). In order to create sufficient space here for these shores 149, 150 when frame 102 is collapsed, the Y-shaped outer ends of spacers 137A, 137B, 138A, 138B are in the shown embodiment provided with a flattened inner surface—wherein only the inner surfaces 151A, 151B of spacers 137A, 137B are visible here. In other embodiments of the load-bearing hinge the spacers can also extend purely radially, as seen from the central axis of the hinge, so that they thus in each case lie pairwise in one line.

Each spacer 137A, 137B and 138A, 138B has here at its free outer end a mounting point, respectively 139A, 139B and 140A, 140B, with which a frame part can be mounted on the load-bearing hinge 108. In the shown embodiment each mounting point 139A, 139B, 140A, 140B comprises a narrowed end part of the relevant spacer 137A, 137B, 138A, 138B, over which a tubular frame part can be placed. The diameter of the narrowed part is adapted to the inner diameter of the tubular frame part such that the frame part can slide thereover close-fittingly and is thus clamped fixedly to hinge 108.

In the shown embodiment the outer ends of spacers 137A, 137B, 138A, 138B are further provided with means for securing the frame tubes placed thereover. Formed in each end part, which takes a hollow form, is a hole 152A, 152B, 153A, 153B in which a pressing member 154A, 154B, 157 is arranged (FIG. 9). Each pressing member 154A, 154B, 157 is urged outward by a flexure spring 155A, 155B, 156A, 156B received in the hollow end part, and then engages in a recess or groove on the inner side of a tubular frame part. The frame parts are thus mounted on load-bearing hinge 108 firmly and without clearance, yet still in easily releasable manner. Spacers 137, 138 all take a slightly curved form so that mounting points 139, 140 at their free outer ends all lie in the same plane, which is defined by toothings 122, 123 of locking parts 120, 121.

The tubular frame parts can otherwise also be manufactured from the same material or from different materials. Materials which can be envisaged are once again steel, light metal and (optionally fibre-reinforced) plastics.

Because hinge 108 is embodied as a load-bearing structure, and the frame parts can be mounted thereon, the frame parts can also take a smaller form than in the prior art seat 1. While frame parts 3, 5 of known seat 1 still extend on either side of hinge 8, and hinge 8 thus in fact protrudes through frame parts 3, 5, this is different in seat 101 according to the invention. The frame parts are now as it were interrupted at the position of hinge 108, whereby their height is almost halved.

As can be seen in FIG. 11, frame 102 of seat 101 can be assembled by mounting frame parts 103, 105, 141 and 142 from four sides on the four spacers 137A, 137B, 138A, 138B of hinge 108. Seat 101 comprises here two of such hinges 108 so that frame parts 103, 105, 141, 142, which are substantially U-shaped, are connected to each other in an X-shape on either side of seat 101. After frame parts 103, 105, 141, 142 have thus been connected to each other, backrest 104 can be arranged on first frame part 103 and seat surface 109 can be tensioned between the first and second frame part 103, 105. Backrest 104 and seat surface 109 are here in the shown embodiment formed integrally from textile material.

Because seat 101 according to the invention comprises four frame parts 103, 105, 141, 142 rather than two frame parts 3, 5 for the known seat 1, it can be stored or packaged smaller in disassembled state.

In order to enable seat 101 to be packaged smaller still, frame parts 103, 105, 141, 142 can themselves also be taken apart into smaller components. Each frame part can thus be constructed from three tubes which are connected to each other by means of two corner pieces into a U-shaped frame part. This can be seen in FIG. 4 for lower frame part 141 on the rear side of seat 101, which is constructed from two tubes 143 which are mounted on hinges 108, and a transverse tube 144 which extends parallel to a connecting line between hinges 108. Tubes 143, 144 are connected to each other by means of corner pieces 145 which also function as feet, which make seat 101 stable. Lower frame part 142 on the front side of seat 101 has a similar construction, while first frame part 103 and second frame part 105 in the shown embodiment also consist of tubes which are connected releasably to each other. In the case of first frame part 103 the transverse tube per se has a U-shape here, and each leg thereof is connected at the position of a bend 146 in first frame part 103 to another tube.

The option of assembling seat 101 from a number of relatively short tube parts which are connected into a stable whole by the load-bearing hinges 108 enables seat 101 to be stored or packaged and transported in a relatively small space. For seat 101 it is thus possible to suffice with a packaging 147, the dimensions of which amount to about half of those of a packaging 148 for conventional seat 1 (FIG. 12).

The invention thus provides a seat which provides an improved functionality and can furthermore be packaged smaller than the known seat. It should otherwise be noted that all the above described new features of the seat according to the invention can per se form essential components of the invention, which can be applied in different combinations. The load-bearing hinge as described here can thus also be applied without locking, in combination with a seat with a folded-out position which is determined by straps/armrests, while the locking of the hinge could on the other hand also be applied in a conventional seat with two different frame parts as shown in FIGS. 1-3.

The scope of the invention is therefore defined solely by the following claims.

The invention claimed is:

1. A seat for video games, comprising:

a collapsible frame which carries a seat surface and a backrest, wherein the frame comprises a first part carrying the backrest and a second part configured to carry a console for a steering wheel or joystick for controlling a video game, which parts are connected pivotally to each other by a hinge, wherein the hinge comprises a first load-bearing body on which the first frame part is mounted, and a second load-bearing body on which the second frame part is mounted, and each load-bearing hinge body has at least two points, lying substantially opposite each other, for mounting of the first or second frame part;

a first locking part connected to a first hinge part; and a second locking part connected to a second hinge part, wherein the first hinge part is rotatable relative to the second hinge part and the locking parts, which are displaceable relative to each other, are each provided with a toothing.

2. A seat according to claim 1, wherein the frame comprises at least four frame parts mounted on the hinge.

3. A seat according to claim 1, wherein the first and second frame part each comprise a number of mutually connected tubular elements.

4. A seat according to claim 3, wherein at least some of the frame parts each comprise three tubes which are assembled by two corner pieces into a substantially U-shaped frame part.

5. A seat according to claim 1, wherein the hinge fixates the first and second frame parts in a desired position relative to each other.

6. A seat according to claim 5, wherein the first and second frame parts are fixated in different positions.

7. A seat according to claim 6, wherein the first locking part and the second locking part are form-fitting.

8. A seat according to claim 6, further comprising a securing member, wherein the locking parts are movable between a first position in which they engage in each other and a second position in which they are displaceable relative to each other, wherein the securing member secures the displaceable locking parts in the first position.

9. A seat according to claim 8, wherein the securing member comprises an eccentric.

10. A seat according to claim 1, wherein one of the locking parts is integrated with the first load-bearing hinge body and the other locking part is integrated with the second load-bearing hinge body.

11. A seat according to claim 1, wherein the toothing comprises a plurality of toothings running at least partially circularly and the locking parts are rotatable relative to each other.

12. A seat according to claim 1, wherein the seat surface and/or the backrest are manufactured from a flexible material.

* * * * *